United States Patent [19]

Kramer

[11] Patent Number: 4,702,933

[45] Date of Patent: Oct. 27, 1987

[54] FABRIC PRESSING DEVICE

[75] Inventor: Carolyn M. Kramer, Cambridge, Mass.

[73] Assignee: Braun Aktiengesellschaft, Kronberg, Fed. Rep. of Germany

[21] Appl. No.: 849,043

[22] Filed: Apr. 7, 1986

Related U.S. Application Data

[62] Division of Ser. No. 759,406, Jul. 26, 1985, Pat. No. 4,665,637.

[51] Int. Cl.[4] ..... B05D 1/10

[52] U.S. Cl. ..... 427/34; 427/292; 427/355; 219/245; 219/464

[58] Field of Search ..... 38/77.45, 77.7, 77.8; 219/245, 461, 464, 462; 427/34, 423, 299, 292, 355

[56] References Cited

U.S. PATENT DOCUMENTS

| | | | |
|---|---|---|---|
| 3,104,482 | 9/1963 | Jepson | 38/77 |
| 3,412,492 | 11/1968 | McCormick | 38/77 |
| 3,480,461 | 11/1969 | Lynge | 38/81 X |
| 3,781,522 | 12/1973 | Borom | 219/462 |
| 3,781,523 | 12/1973 | Borom | 219/462 |
| 3,781,528 | 12/1973 | Schrewelius | 219/462 |
| 3,798,759 | 3/1974 | Gerds | 29/611 |
| 3,816,704 | 6/1974 | Borom | 219/462 |
| 3,906,187 | 9/1975 | Turoczi | 219/254 |
| 4,196,340 | 4/1980 | Evans | 219/245 |
| 4,206,340 | 6/1980 | Osrow | 219/272 |
| 4,221,672 | 9/1980 | McWilliams | 252/62 |
| 4,243,016 | 1/1981 | Kristen | 219/464 |
| 4,405,659 | 9/1983 | Strangman | 427/248.1 |
| 4,542,111 | 9/1985 | Buran | 501/127 |
| 4,588,021 | 5/1986 | Bergeron | 427/34 |

*Primary Examiner*—Shrive P. Beck

[57] ABSTRACT

A fabric pressing device has a composite sole plate with a base component of metal or similar thermally conductive material that is coupled to the heat source of the pressing iron, and a layer of ceramic bonded to the base component. The ceramic layer has a planar fabric pressing surface that preferably has a smoothness of at least about a nominal two micrometers surface roughness. That ceramic surface is highly resistant to wear and to impact, is easy to clean, and has excellent dynamic and static frictional characteristics on textile fabrics.

8 Claims, 6 Drawing Figures

FIG 1
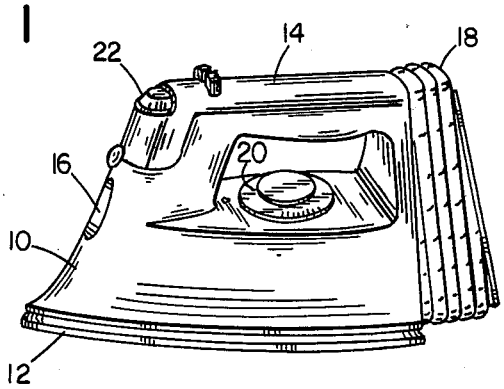
FIG 2
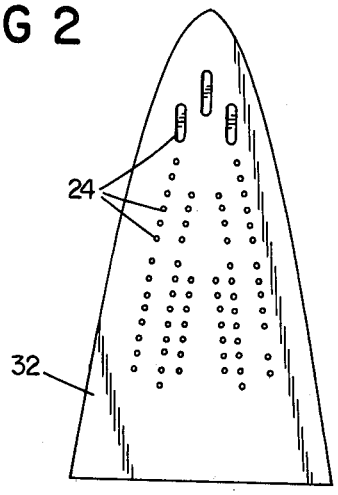
FIG 3
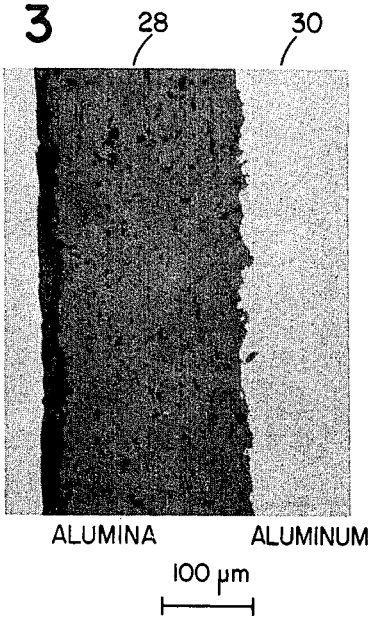
FIG 4
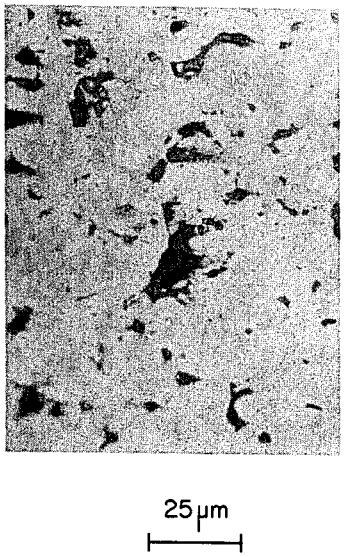
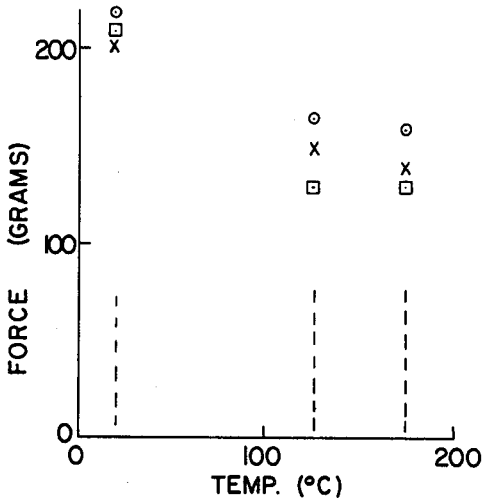
FIG 5
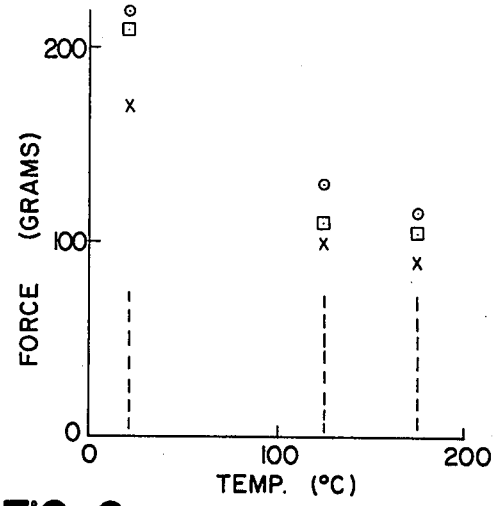
FIG 6

FABRIC PRESSING DEVICE

This application is a division of prior pending Ser. No. 759,406 filed July 26, 1985, now U.S. Pat. No. 4,665,637.

This invention relates to fabric pressing devices.

Manual pressing devices preferably are light in weight and should slide easily across the fabric so that they can be easily manipulated during pressing, and the fabric contacting surface should impart the desired smoothing action on the fabric. Such fabric pressing devices have a heat source that heats a sole plate (typically of metal or plastic) which defines the surface that contacts the fabric to be pressed. The temperature of the sole plate typically is adjustable as a function of characteristics of the fabric to be ironed, and as pressing action is frequently enhanced with the presence of steam, the pressing device frequently includes a water chamber and means for generating steam which is discharged through ports in the sole plate during the pressing action. In order to improve the manipulability of the pressing device on the fabric, and to reduce weight (make the pressing device easier to handle), the fabric pressing surfaces of such devices are frequently made of aluminum and/or coated with a low friction polymeric material such as polytetrafluoroethylene. Such surfaces are easily and frequently scratched or marred, for example by efforts to clean the soleplate surface to remove adhering foreign substances or by the pressing action itself (due for example to grit embedded in the fabric being pressed), such scratching or marring tending to reduce the effectiveness of the fabric smoothing action of the pressing device.

In accordance with one aspect of the invention, there is provided a fabric pressing device that has a composite sole plate with a base component of thermally conductive material that is coupled to the heat source of the pressing iron, and a layer of ceramic bonded to the base component, the ceramic layer having a thickness in the range of about fifty to about five hundred micrometers and a smooth fabric pressing surface that preferably has a smoothness of at least about a nominal two micrometers surface roughness. That ceramic surface is highly resistant to wear and to impact and has excellent dynamic and static frictional characteristics. The ceramic layer does not have adverse effect on the heat-up rate of the device, that heat-up rate being substantially the same as that of an iron with an uncoated (bare aluminum) soleplate. In particular embodiments, the ceramic layer is composed of ceramic particles (for example, a carbide, a boride, or a metal oxide such as alumina, cobalt oxide, titania or mixtures of such ceramics) that are bonded together, the ceramic particles having a diamond pyramid hardness number (DPHN); of more than one thousand (ten gram load).

In accordance with another aspect of the invention, there is provided a method of manufacturing a fabric pressing device comprising the steps of providing a base component of thermally conductive material that is adapted to be coupled to the heat source of the pressing device and that has a rough surface, adhering a layer of ceramic material having a thickness in the range of about fifty to about five hundred micrometers to the rough surface of the base component, and smoothing the surface of the adhered layer of ceramic material to provide a planar fabric pressing surface. While the ceramic layer may be adhered by various technologies such as chemical vapor deposition or sputtering, in preferred embodiments, after the surface of the base component is roughened by grit blasting to provide a resulting roughened surface that has a typical peak-to-valley dimension of at least about ten micrometers, ceramic particles that are entrained in and heated by a plasma stream are sprayed on the roughened base component surface, the heated particles deforming on impact on the base component to form a bonded ceramic layer that has a density of at least about eighty percent. The surface of the resulting ceramic layer is then smoothed by polishing to a surface quality of at least about one micrometer surface roughness.

In a particular embodiment, the fabric pressing iron device includes a body which contains a water holding chamber and steam generating means, and the sole plate has ports in communication with the steam chamber for passing steam to the sole plate surface for contact with the fabric being ironed, a heating element is embedded in the base component, and a power supply conductor and a control are provided for adjusting the temperature of the sole plate. The passing iron is easy to manipulate, its sole plate is highly resistant to wear and impact, is easy to clean, and the frictional characteristics of the fabric-ceramic material pair are comparable or superior to commercially available pressing irons with polymeric coatings on their sole plates.

Other features and advantages of the invention will be seen as the following description of particular embodiments progresses, in conjunction with the drawings, in which:

FIG. 1 is a perspective view of a fabric pressing iron device in accordance with the invention;

FIG. 2 is a plan view on the sole plate of the pressing iron device of FIG. 1;

FIG. 3 is a photomicrographic cross sectional view of the sole plate of the pressing iron device of FIG. 1 before polishing;

FIG. 4 is a photomicrographic view of the polished sole plate surface of the pressing iron device of FIG. 1;

FIG. 5 is a graphical presentation of comparative static frictional forces of pressing iron devices in accordance with the invention and prior art pressing iron devices; and FIG. 6 is a graphical presentation of comparative dynamic frictional characteristics of pressing iron devices in accordance with the invention and prior art pressing iron devices.

DESCRIPTION OF PARTICULAR EMBODIMENTS

Shown in FIG. 1 is a fabric pressing iron device that has a body 10 with sole plate structure 12 and manipulating handle 14. Formed in body 10 is a chamber for storing water (that is filled and emptied through port 16). A heating element in body 10 is in intimate contact with the sole plate 12 and is energized via power supply cord 18 and controlled by temperature adjusting disc 20 to vary the temperature of sole plate 12. The pressing iron also includes steam control 22. Formed in the bottom of sole plate 12 (as indicated in FIG. 2) is an array of ports 24 through which steam is flowed to enhance pressing effectiveness.

Sole plate 12 is composed of ceramic layer 28 that is bonded to the underlying heat distributing aluminum base 30 (as shown in the photomicrographic sectional view of FIG. 3). The composite sole plate structure 12 is formed by cleaning and roughening aluminum base 30 with a grit blast (the resulting roughened surface having a typical peak-to-valley dimension of about twenty micrometers) and then applying a layer of ceramic material to a thickness of up to about two hundred micrometers. In the embodiment shown in FIGS. 3 and 4, alumina in the form of ten micrometer spheres is heated in a plasma stream generated by a plasma spray gun and sprayed on base 30, the heated spheres deforming upon impact to disk shape of about one micron thickness and providing a bonded ceramic layer 28 that has a density of about ninety percent.

After alumina layer 28 has been deposited, its surface 32 is smoothed with a silicon carbide embedded nylon wheel and then polished with diamond paste to a nominal surface roughness of about one micron. A photomicrograph of the polished ceramic (alumina) surface is shown in FIG. 4, the dark spots in the photomicrograph of FIG. 4 being voids or pores. The alumina particles have a hardness of about 2,400 dphn (ten gram load). The polished sole plate surface 32 heats up at rates that are substantially the same as that of uncoated (bare aluminum) soleplates, is easy to clean and is highly resistant both to wear and to impact.

Frictional characteristics of pressing iron devices with ceramic sole plates in accordance with the invention were evaluated or compared with similar fabric pressing devices with aluminum sole plates and with aluminum sole plates that have polymeric coatings such as Teflon (PTFE) containing coatings. Each of the compared irons had a weight of about 1.1 kilograms and their frictional characteristics were measured on a variety of textile fabrics and at different pressing temperatures. Comparisons of frictional characteristics of those pressing iron devices on linen fabrics are set forth in FIGS. 5 and 6, the comparisons shown in FIG. 5 being of static characteristics and the comparisons in FIG. 6 being of dynamic characteristics. In those Figures, the frictional characteristics of the prior art aluminum sole plate are represented by circles, the characteristics of the composite ceramic sole plate in accordance with the invention are represented by squares, and the frictional characteristics of Teflon (PTFE) containing coatings on aluminum sole plates are represented by "X"s. While the static frictional characteristics on linen of the three sole plates at ambient temperature are substantially the same (at or slightly above 200 grams of force), the static friction characteristics of the ceramic composite sole plates at 125° C. and 175° C. on linen were less than either irons with aluminum sole plates or irons with PTFE coated sole plates. As shown in FIG. 6, the dynamic frictional characteristics of the PTFE coated sole plates on linen were significantly better at room temperature but the composite ceramic sole plate dynamic frictional characteristics on linen at 125° C. and at 175° C. were substantially the same as the PTFE coated sole plates and better than the dynamic frictional characteristics of the aluminum sole plates.

Set forth in the following table is a comparison of static and dynamic friction (pulling forces in grams) of the three types of sole plates on silk at 110° C.:

TABLE 1

| Sole Plate | Static | Dynamic |
|---|---|---|
| Teflon | 166 | 106 |
| Aluminum | 144 | 106 |
| Alumina | 134 | 114 |

As will be noted, the static frictional characteristics of the composite ceramic (alumina) sole plates were better than either the Teflon coated sole plates or the aluminum sole plates, and the dynamic frictional characteristics were substantially the same.

Table 2 sets out a similar comparison of static and dynamic frictional characteristics of the three types of pressing devices on denim at 175° C.:

TABLE 2

| Sole Plate | Static | Dynamic |
|---|---|---|
| Teflon | 140 | 90 |
| Aluminum | 136 | 116 |
| Alumina | 106 | 80 |

As can be seen from Table 2, both the static and dynamic frictional characteristics of the composite ceramic (alumina) sole plates were superior to the frictional characteristics of both the sole plates with PTFE (Teflon) containing coatings and the aluminum sole plates. A similar comparison of static and dynamic frictional characteristics (average of five tests each) on denim at 160° C. of three different types of composite soleplate pressing devices (ceramic layers of alumina, cobalt oxide, and an alumina-titania mixture) with a commercially available iron that had a Teflon-containing coating on an aluminum soleplate produced similar results—both the static and dynamic frictional characteristics of the composite metal-ceramic soleplates were superior to the frictional characteristics of the iron with an aluminum soleplate with a PTFE (Teflon) containing coating, while the static and dynamic frictional characteristics of an iron with a composite metal-titania soleplate was slightly inferior to the frictional characteristics of the iron with a PTFE (Teflon) containing coating on an aluminum soleplate. Pressing devices in accordance with the invention have sturdy soleplate surfaces that are easy to clean. While the frictional characteristics of soleplate surfaces on textile fabrics appear to be complex functions of temperature, the nature of the textile fabric and the soleplate material, the frictional characteristics of pressing devices in accordance with the invention are equal to or better than commercially available pressing devices with polymeric coatings (such as PTFE) on their soleplate surfaces.

While particular embodiments of the invention have been shown and described, various modifications will be apparent to those skilled in the art, and therefore is not intended that the invention be limited to the disclosed embodiment or to details thereof, and departures may be made therefrom within the spirit and scope of the invention.

What is claimed is:

1. A method of manufacturing a fabric pressing device comprising the steps of providing a base component of thermally conductive material that is adapted to be coupled to the heat source of the pressing device and that has a rough surface, adhering a layer of ceramic material to said rough surface of said base component by heating ceramic particles, spraying said heated particles onto said rough surface of said base component to form a ceramic layer that has a thickness of at least about fifty micrometers, and that is composed of ceramic particles that are bonded together, and smoothing the surface of said adhered layer of ceramic material to provide a planar fabric pressing surface.

2. The method of claim 1 wherein said surface of said ceramic layer is smoothed to a surface quality of at least about one micrometer surface roughness.

3. The method of claim 1 and further including the step of roughening the surface of said base component by grit blasting to provide a resulting roughened surface that has a typical peak-to-valley dimension of at least about ten micrometers.

4. The method of claim 3 wherein said ceramic particles are heated in a plasma stream generated by a plasma spray gun and said ceramic layer has a thickness in the range of about fifty to about five hundred micrometers.

5. The method of claim 4 wherein said layer of bonded ceramic particles is smoothed by polishing action to provide a resulting planar surface that has a typical peak-to-valley dimension of less than about one micrometer.

6. The method of claim 5 wherein said ceramic particles are composed of a metal oxide.

7. The method of claim 6 wherein said ceramic particles have a hardness of more than one thousand DPHN (ten gram load) and said layer has a density of at least about eighty percent.

8. The method of claim 6 wherein said metal oxide is selected from the group consisting of alumina, titania, cobalt oxide, and a mixture of such metal oxides.

* * * * *